US011198454B2

(12) United States Patent
Trent et al.

(10) Patent No.: US 11,198,454 B2
(45) Date of Patent: Dec. 14, 2021

(54) TORQUE BOX

(71) Applicant: TRINITY RAIL GROUP, LLC, Dallas, TX (US)

(72) Inventors: Robert S. Trent, Willow Springs, IL (US); David C. Brabb, Westmont, IL (US); Anand Prabhakaran, Chicago, IL (US)

(73) Assignee: TRINITY RAIL GROUP, LLC, Dallas, TX (US)

( * ) Notice: Subject to any disclaimer, the term of this patent is extended or adjusted under 35 U.S.C. 154(b) by 774 days.

(21) Appl. No.: 16/065,403

(22) PCT Filed: Jun. 6, 2018

(86) PCT No.: PCT/US2018/036174
§ 371 (c)(1),
(2) Date: Jun. 22, 2018

(87) PCT Pub. No.: WO2018/231596
PCT Pub. Date: Dec. 20, 2018

(65) Prior Publication Data

US 2021/0206400 A1 Jul. 8, 2021

Related U.S. Application Data

(60) Provisional application No. 62/518,326, filed on Jun. 12, 2017.

(51) Int. Cl.

| | |
|---|---|
| ***B61D 3/00*** | (2006.01) |
| ***B61D 17/08*** | (2006.01) |
| *B61F 1/08* | (2006.01) |

(52) U.S. Cl.
CPC ..... *B61D 3/00* (2013.01); *B61D 17/08* (2013.01); *B61F 1/08* (2013.01)

(58) Field of Classification Search
CPC .... B61D 3/00; B61D 3/08; B61D 3/16; B61F 1/00; B61F 1/02; B61F 1/08; B61F 1/10
See application file for complete search history.

(56) References Cited

U.S. PATENT DOCUMENTS

| | | | | |
|---|---|---|---|---|
| 2,013,583 | A | 9/1935 | Sanford | |
| 3,859,928 | A | 1/1975 | Adler | |
| 4,805,539 | A * | 2/1989 | Ferris | B61D 3/20 105/158.2 |
| 6,299,240 | B1 | 10/2001 | Schroeder et al. | |
| 6,510,800 | B1 | 1/2003 | Zaerr et al. | |

OTHER PUBLICATIONS

International Search Report and Written Opinion for PCT Patent Application No. PCT/US18/36174, dated Aug. 30, 2018; 7 pages.
International Preliminary Report on Patentability for PCT Patent Application No. PCT/US18/36174, dated Dec. 26, 2019; 5 pages.

* cited by examiner

*Primary Examiner* — Robert J McCarry, Jr.
(74) *Attorney, Agent, or Firm* — Baker Botts, LLP

(57) ABSTRACT

A torque box includes a front plate and a bottom surface. The bottom surface is coupled to the front plate such that the bottom surface is orthogonal to front plate and such that front plate extends along the bottom surface. The bottom surface defines a first raised portion configured to fit over a wheel of a railcar.

21 Claims, 8 Drawing Sheets

TORQUE BOX

CROSS REFERENCE TO RELATED APPLICATIONS

This application claims the benefit of U.S. Provisional Application Ser. No. 62/518,326, entitled "Torque Box," which was filed Jun. 12, 2017, having common inventorship, the entire contents of which are incorporated herein by reference.

PRIORITY

This nonprovisional application is a U.S. National Stage Filing under 35 U.S.C. § 371 of International Patent Application Serial No. PCT/US2018/36174 filed Jun. 6, 2018, and entitled "Torque Box" which claims priority to S. Provisional Patent Application No. 62/518,326 filed Jun. 12, 2017, both of which are hereby incorporated by reference in their entirety.

TECHNICAL FIELD

This disclosure relates generally to configuring a railroad freight car (also referred to as a "railcar").

BACKGROUND

Railcars are configured to store and transport freight across long distances. As more freight is placed inside a railcar, the stress placed on the structure of the railcar increases.

SUMMARY

Railcars are configured to store and transport freight across long distances. For example, railcars may store and transport automobiles, military equipment, livestock, construction equipment, etc. As more freight is loaded and transported by the railcar, the stress placed on the railcar and connections to other railcars increases. If this stress is not controlled, the railcar may break, deform, or otherwise fail.

Existing railcars use different mechanisms and designs to control these stresses. For example, some railcars use a shear plate design that transfers stress between portions of the railcars. Other railcars have attached a device known as a "torque box" that also helps control the stress on the segments of the railcars. However, each of these mechanisms and designs has drawbacks. A shear plate design may be heavy and costly to manufacture. A conventional torque box may need to be offset vertically from the railcar to create clearance for wheel structures. The offset may increase the stress on the railcar when freight is transported.

This disclosure contemplates an improved torque box design that allows the torque box to be lowered on the railcar. In this manner, the vertical offset between the torque box and the railcar is reduced, thus reducing the stress placed on the railcar by reducing the moment arm between the longitudinal draft line of force between the torque box and a top chord of the railcar as freight is transported. The improved torque box includes a lower segment that has raised portions (also referred to as a corrugated design). The raised portions allow clearance for wheel structures when the torque box is lowered. Additionally, the raised portions reduce the weight of the torque box. The torque box acts as a structural component of the well car as well as an efficient force transmission system to the rest of the car body and on through to the next car in some embodiments. Three embodiments are described below.

According to an embodiment, a torque box includes a front plate and a bottom surface. The bottom surface is coupled to the front plate such that the bottom surface is orthogonal to front plate and such that front plate extends along the bottom surface. The bottom surface defines a first raised portion configured to fit over a wheel of a railcar.

According to another embodiment, a railcar includes a body segment, a wheel structure, and a torque box. The wheel structure is coupled to the body segment. The torque box is coupled to the body segment. The torque box includes a front plate and a bottom surface. The bottom surface is coupled to the front plate such that the bottom surface is orthogonal to front plate and such that front plate extends along the bottom surface. The bottom surface defines a first raised portion configured to fit over a wheel of the wheel structure.

According to yet another embodiment, a method includes attaching a torque box to a well car. The well car includes a wheel structure. The torque box includes a front plate and a bottom surface. The bottom surface is coupled to the front plate such that the bottom surface is orthogonal to front plate and such that front plate extends along the bottom surface. The bottom surface defines a first raised portion configured to fit over a wheel of the wheel structure. The method also includes attaching the well car to a railcar.

Certain embodiments may provide one or more technical advantages. For example, an embodiment allows a torque box to be lower on a railcar compared to conventional designs. As another example, an embodiment reduces the stress placed on a railcar during transport. As yet another example, an embodiment allows clearance for wheel structures to allow for a torque box to be lowered. Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of this disclosure, reference is now made to the following brief description, taken in connection with the accompanying drawings and detailed description, wherein like reference numerals represent like parts.

DETAILED DESCRIPTION

Figure 1A:
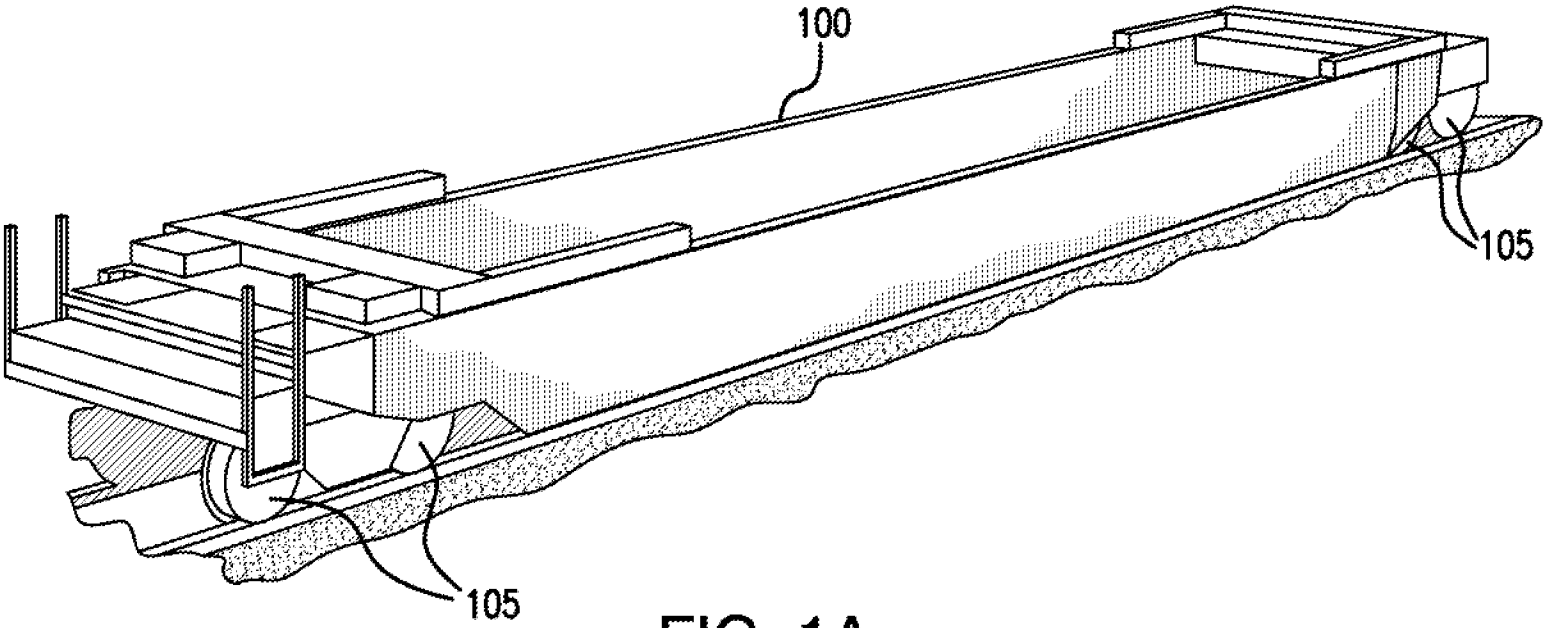
FIG. 1A illustrates an example well car.

Railcars are configured to store and transport freight across long distances. For example, railcars may store and transport automobiles, military equipment, livestock, construction equipment, etc. This disclosure contemplates a railcar that is configured to store and transport any type of freight. A well car is a type of railcar. A well car includes a well that is used to carry freight. FIG. 1A illustrates an example well car 100. Well car 100 includes one or more wheel structures 105 that are used to move well car 100 over rails. This disclosure contemplates well car 100 including any number of wheel structures 105. The longer well car 100 is, the more wheel structures 105 it may have. Each wheel structure 105 includes one or more wheels coupled to one or more axles.

Figure 1B:
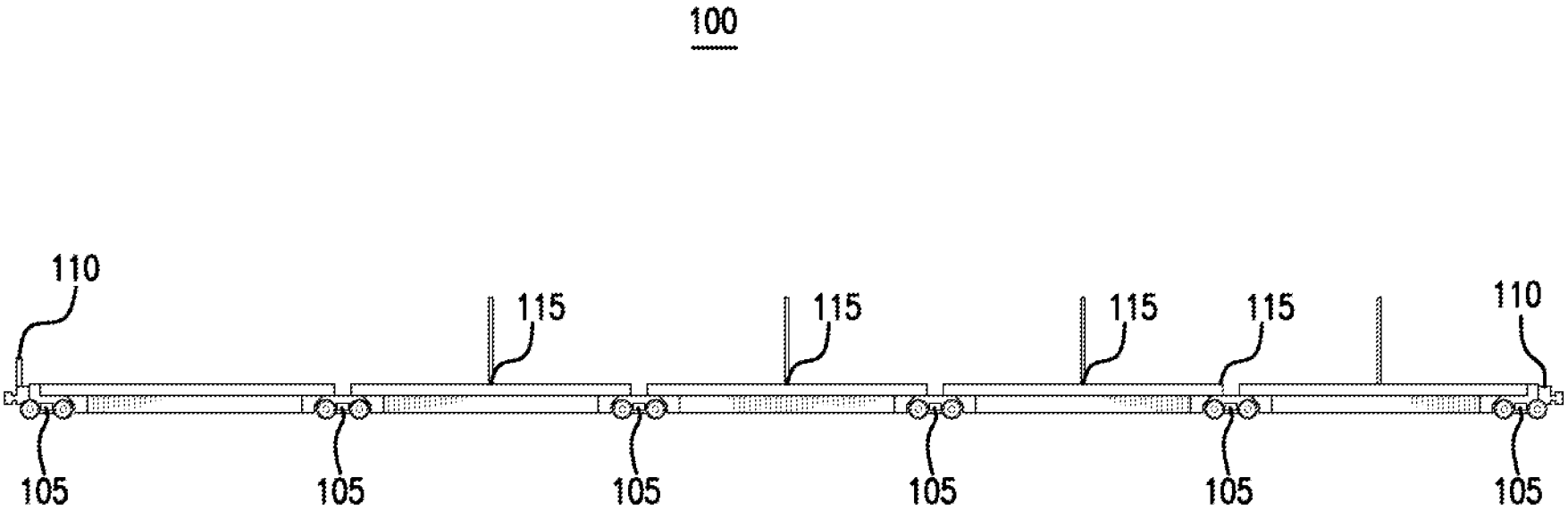
FIG. 1B illustrates an example well car.

FIG. 1B illustrates an example well car 100. In the example of FIG. 1B, well car 100 includes six wheel structures 105. The example well car 100 of FIG. 1B includes several well segments 115, whereas the example well car 100 of FIG. 1A includes a singular well segment. Two of the wheel structures 105 are located at the ends of well car 100. The other wheel structures 105 are located along the body of well car 100. The ends of well car 100 also include couplers 110 that are used to couple well car 100 to other railcars.

The body of well car 100 includes well segments 115 that are attached to wheel structures 105. Well segments 115 include wells that allow freight (such as shipping containers) to be lowered into well segments 115 for transport. As more freight is loaded and transported by well car 100 and/or as well car 100 is attached to other railcars, the stress placed on well segments 115, wheel structures 105, and the connection between well segments 115 increases. If this stress is not controlled, well segments 115 may break, deform, or otherwise fail.

Existing well cars use different mechanisms and designs to control the stress on well segments 115. For example, some well cars use a shear plate design that transfers stress between portions of well car 100. Other well cars have included in well segments 115 a device known as a "torque box" that also helps control the stress on well segments 115. However, each of these mechanisms and designs have drawbacks. A shear plate design may be heavy and costly to manufacture. A conventional torque box may need to be offset vertically from well segment 115 so as to create clearance for wheel structures 105. The offset may increase the stress on well segments 115 when freight is transported by well cars 100.

This disclosure contemplates an improved torque box design that allows the torque box to be lowered on well segment 115 and that reduces the weight of the torque box. In this manner, the vertical offset between the torque box and well segment 115 is reduced, thus reducing the stress placed on well segment 115 by reducing the moment arm between the longitudinal draft line of force between the torque box and the top chord of well segment 115 as freight is transported by well car 100. The improved torque box includes a lower segment that has raised portions (also referred to as a corrugated design). The raised portions allow clearance for wheel structure 105 when the torque box is lowered. Additionally, the raised portions reduce the weight of the torque box. The torque box acts as a structural component of the well car as well as an efficient force transmission system to the rest of the car body and on through to the next car in some embodiments. The improved torque box will be described in more detail using FIGS. 2 through 4. Although this disclosure describes the improved torque box design being implemented on a well car, it is contemplated that the improved torque box design can be implemented on many types of railcars. This disclosure is not limited to well cars.

Although the torque box is illustrated as an open structure in certain figures, this disclosure contemplates that the torque box is an enclosed structure (e.g., a closed box). Certain panels or surfaces of the torque box are not illustrated so that certain features of the torque box can be seen.

In some embodiments, well car 100 is a railroad freight car that includes a light weight integrated torque box and draft sill with shallow in-line longitudinal load path and a corrugated bottom plate structure for wheel clearance. The torque box may be light weight in comparison with other end-of-car structures. The torque box may be integrated with the draft sill and draft pocket which reduces the moment arm from the coupler to the well car top chord which in-turn reduces car body stresses and deflections seen by the lighter weight well car designs. The torque box may include a corrupted bottom plate that allows for the low positioning of the torque box relative to the rest of the car and wheel structures, while providing clearance for truck and wheel rotation. In some embodiments, reducing the moment offset allows coupler forces to be transmitted through the car in a more axial manner, allowing the structure to be more efficient.

Figure 2A:
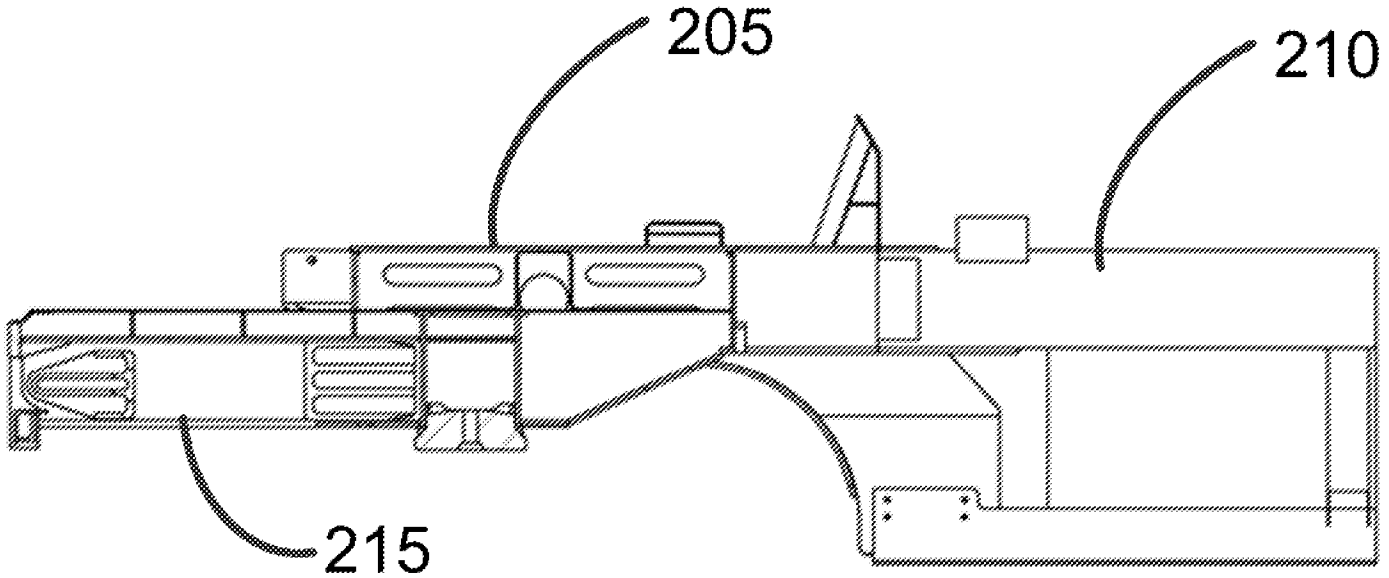
FIG. 2A illustrates an example coupler end of an example well car.

FIG. 2A illustrates a side view of coupler end of well car 100. The coupler end includes a torque box 205, a top chord 210, and a draft sill 215. Top chord 210 may be part of a well segment 115. Draft sill 215, along with other related components (not shown), may be used to couple well car 100 to another railcar. Torque box 205 attaches to both top chord 210 and end sill 215. As shown in the example of FIG. 2A, torque box 205 may be attached flush with top chord 210 so that there is no vertical offset between torque box 205 and top chord 210.

Figure 2B:
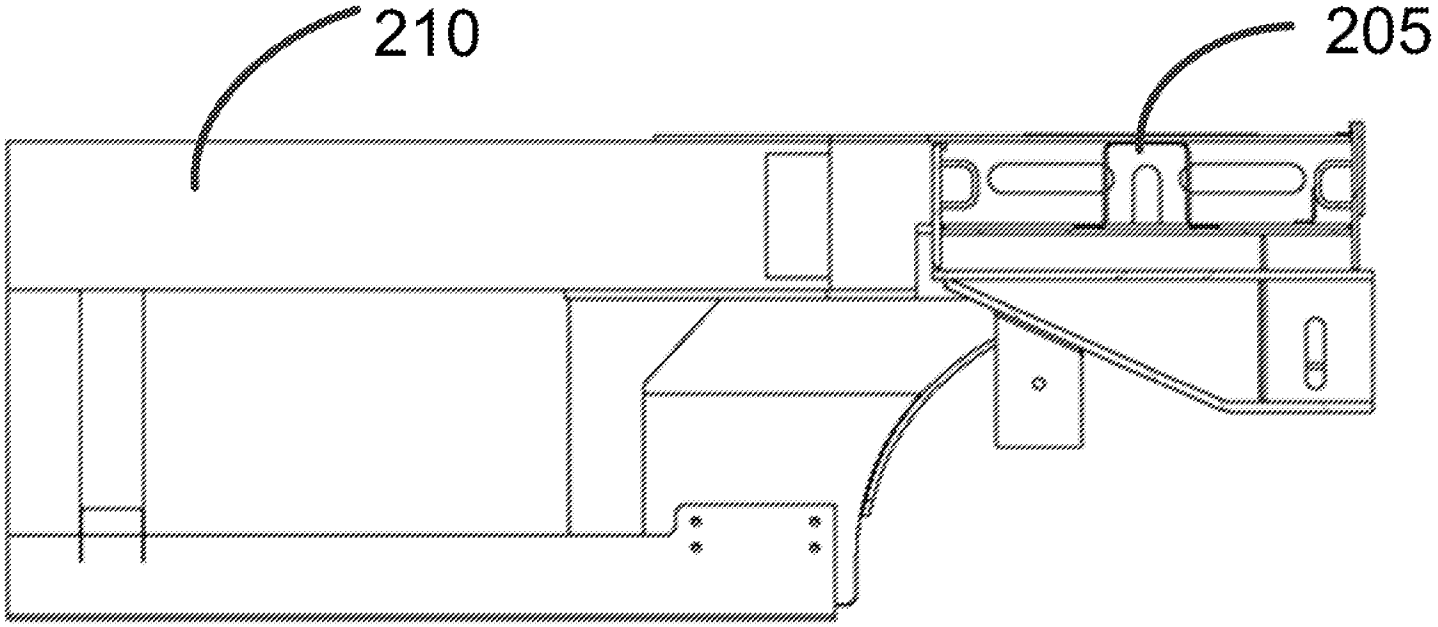
FIG. 2B illustrates an example articulated end of an example well car.

FIG. 2B illustrates a side view of an example articulated end of well car 100. The articulated end may be an end of a well segment 115 along the body of well car 100 (e.g., not at an end of the string of well cars). As illustrated in FIG. 2B, the articulated end includes a torque box 205 and a top chord 210. The articulated end may couple to a wheel structure 105 (not illustrated) below and offset from torque box 205. Similar to the example of FIG. 2A, torque box 205 may be attached flush with top chord 210 so that there is no vertical offset with top chord 210.

Although this disclosure illustrates torque box 205 being attached flush with top chord 210, this disclosure contemplates torque box 205 being attached to top chord 210 such that a minimal offset exists between torque box 205 and top chord 210. In other words, torque box 205 need not eliminate completely the offset between torque box 205 and top chord 210. In some embodiments, the offset between torque box 205 and top chord 210 is reduced by at least three inches over conventional torque box designs.

Figure 3A:
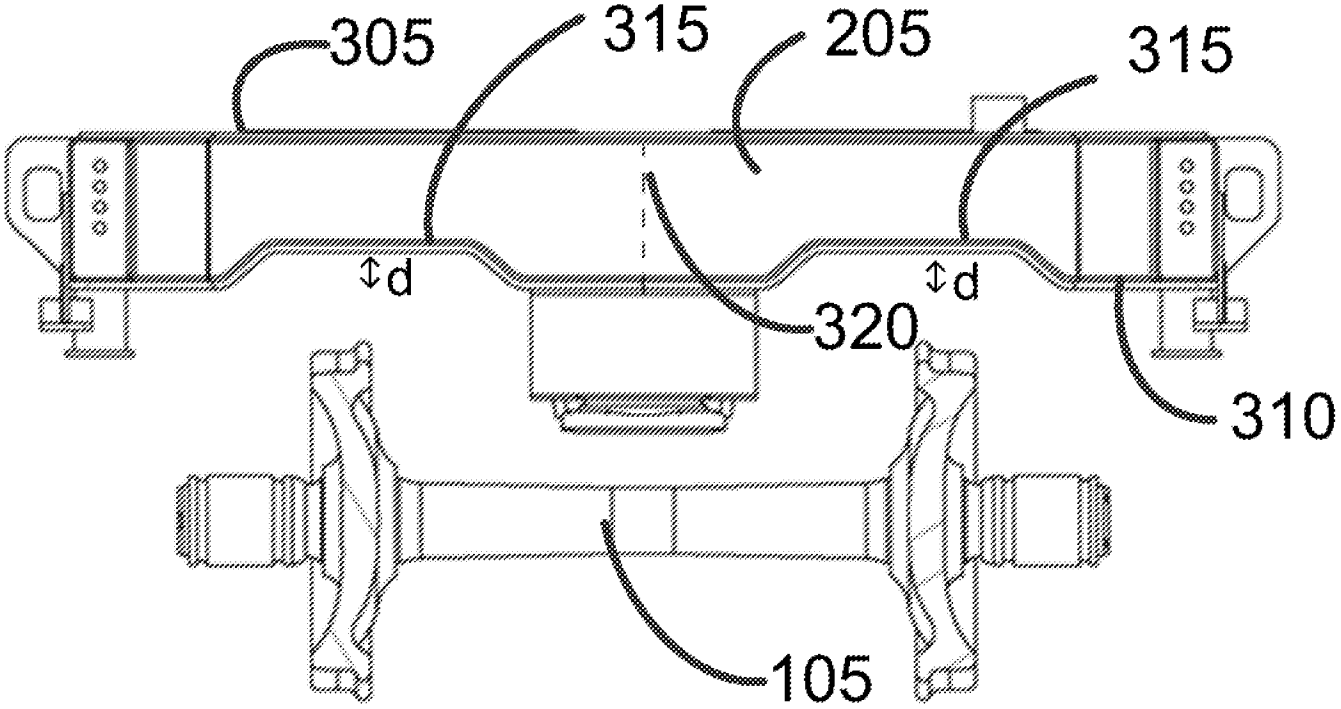
FIG. 3A illustrates an example torque box and wheel structure.

FIG. 3A illustrates a front view of an example torque box 205 and wheel structure 105. In the example of FIG. 3A, torque box 205 includes a front plate 305 and a bottom surface 310. Front plate 305 is coupled to bottom surface 310 such that front plate 305 is orthogonal to bottom surface 310 and such that front plate 315 is positioned above bottom surface 310. In the illustrated example of FIG. 3A, front plate 305 is positioned such that a bottom edge of front plate 305 is proximate a front edge of bottom surface 310. Front plate 305 has a length that extends along the front edge of bottom surface 310. Front plate 305 forms a surface of torque box 205 that is closest to draft sill 215.

Bottom surface 310 includes raised portions 315 (also referred to as a corrugated structure) that provide clearance for wheel structure 105. By shaping bottom surface 310 to include raised portions 315, torque box 205 may be lowered by at least three inches and still provide clearance for wheel structure 105 in some embodiments. Also, raised portions 315 reduce the weight of torque box 205 in some embodiments. Front plate 305 is configured to accommodate raised portions 315. For example, a bottom edge of front plate 305 is shaped to engage raised portion 315. This disclosure may refer to bottom surface 310 as defining one or more raised portions 315.

Each raised portion 315 is offset from a midline 320 of bottom surface 310 such that a raised portion 315 is positioned on opposite sides of midline 320. In some embodiments, the raised portions 315 are positioned equidistant from midline 320. In the illustrated example of FIG. 3A, a raised portion 315 is positioned to the left of midline 320 and another raised portion 315 is positioned to the right of midline 320. Each raised portion 315 is configured to fit over a portion of wheel structure 105. For example, each raised portion 315 may be raised a distance 'd' (e.g., 3 inches or more) above bottom surface 310 to fit over a wheel of wheel structure 105. As can be seen in the example of FIG. 3A, torque box 205 can be lowered towards wheel structure 105 without bottom surface 310 contacting a wheel of wheel structure 105 because bottom surface 310 includes raised portions 315 positioned over the wheels of wheel structure 105.

In the illustrated example of FIG. 3A, bottom surface 310 is positioned above draft sill 215. Torque box 205 and bottom surface 310 are positioned above draft sill 215 and coupled to draft sill 215. Draft sill 215 is positioned along midline 320. Raised portions 315 are positioned to either side of draft sill 215. One raised portion 315 is positioned to the left of draft sill 215 and the other raised portion 315 is positioned to the right of draft sill 215.

Figure 3B:
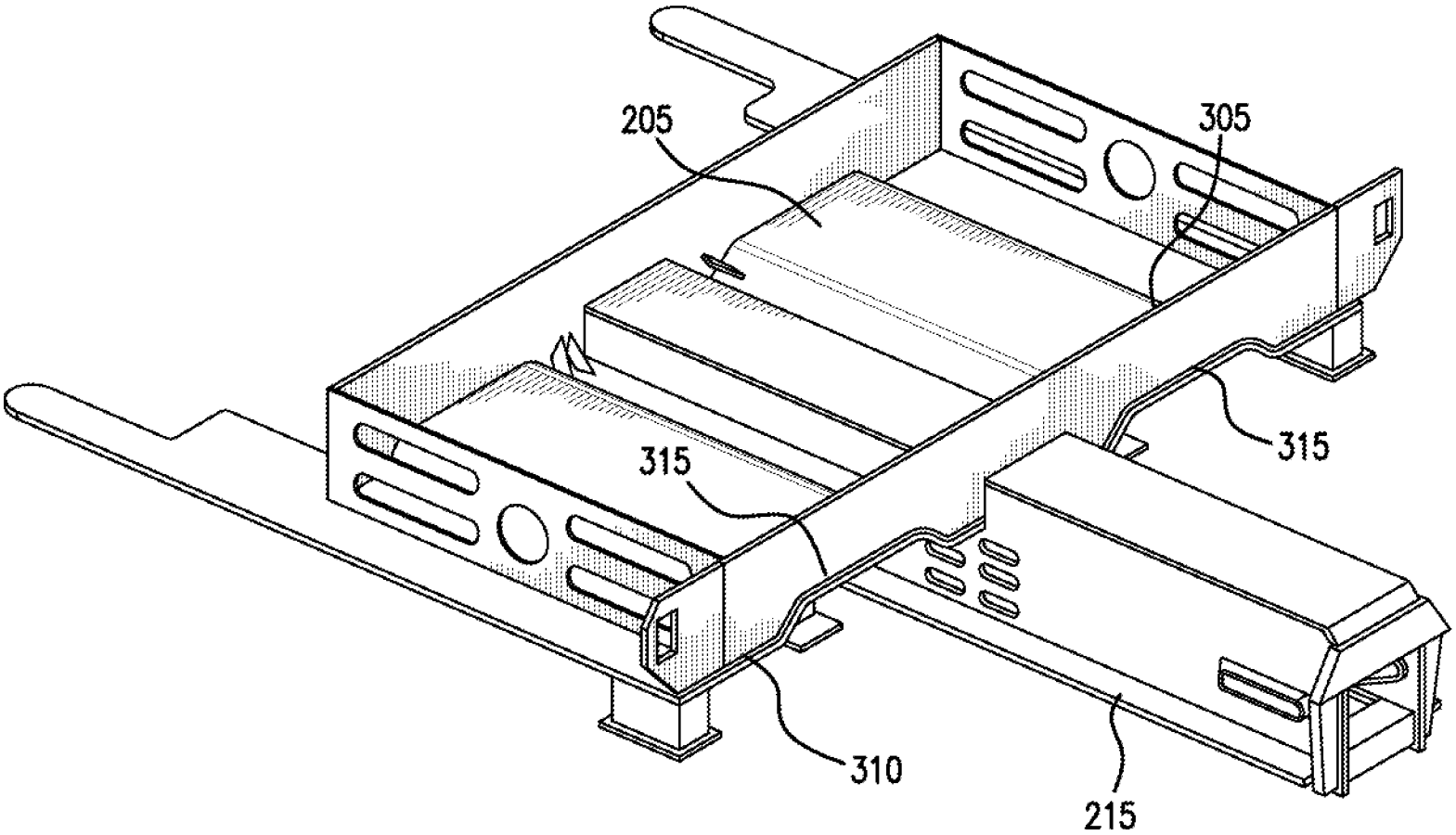
FIG. 3B illustrates an example torque box of an example coupler end.
Figure 3C:
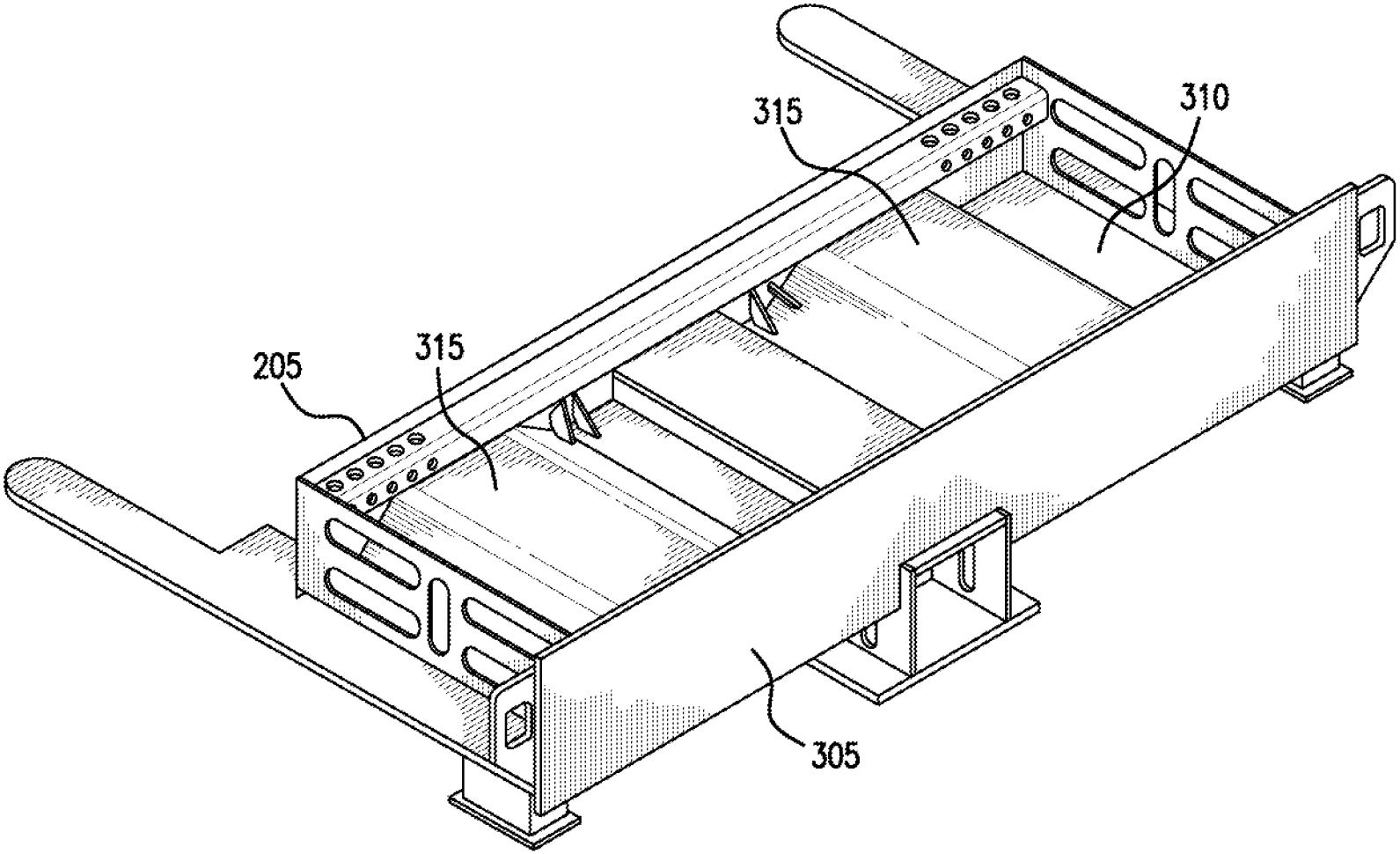
FIG. 3C illustrates an example torque box of an example articulated end.

FIG. 3B illustrates an example torque box 205. In the example of FIG. 3B, torque box 205 includes front plate 305 and bottom surface 310. Torque box 205 is attached to draft sill 215. Raised portions 315 are also included in bottom surface 310. FIG. 3C illustrates an example torque box 205 at an articulated end of well car 100. In the example of FIG. 3C, torque box 205 includes front plate 305 and bottom surface 310. Raised portions 315 are included in bottom surface 310.

In certain embodiments, torque box 205 includes a raised portion along the midline of torque box 205 that allows draft sill 215 to engage torque box 205. This raised portion is sufficiently wide to allow portions of draft sill 215 to fit within this raised portion. This raised portion allows torque box 205 to be further lowered onto draft sill 215 and towards wheel structure 105.

Figure 4:
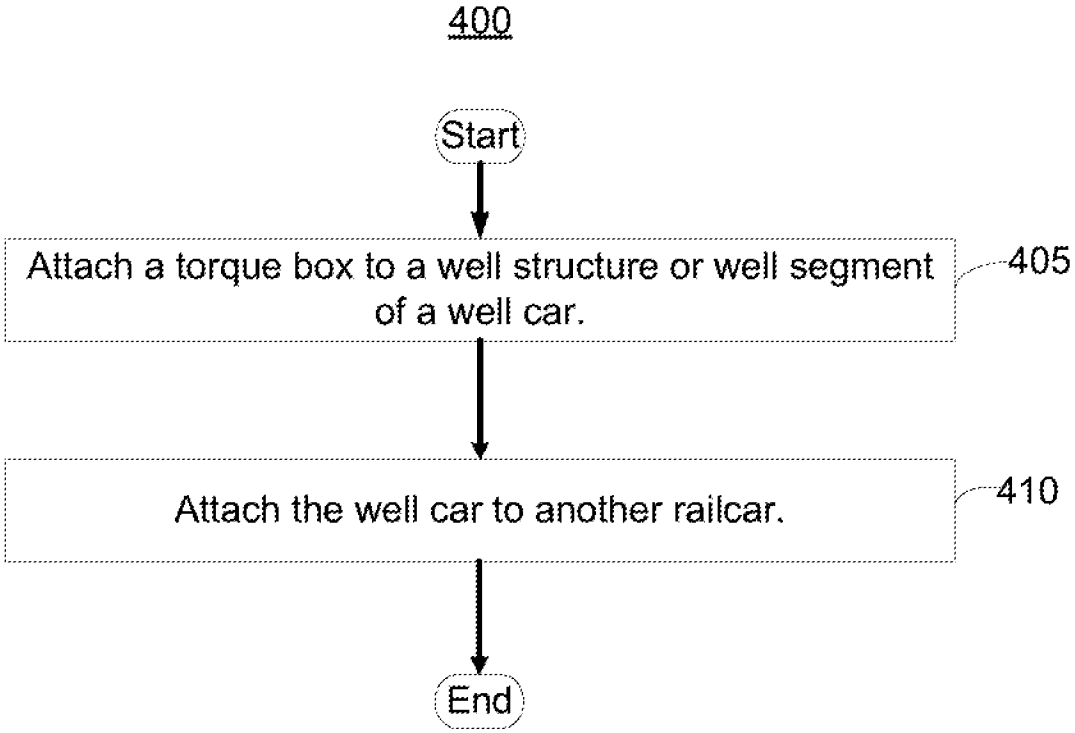
FIG. 4 is a flowchart illustrating a method of reinforcing a well car.

FIG. 4 is a flowchart of an example method 400 for controlling the stress on the structure of a well car. The method includes attaching a torque box to a well structure or well segment of a well car in step 405 and attaching the well car to another railcar in step 410.

In some embodiments, the well car attaches to another railcar through another torque box. The attached torque box includes a bottom surface that is corrugated. The bottom surface has raised portions that allow the torque box to be further lowered towards a wheel structure of the well car. In some instances, the raised portions are raised 3 or more inches from the bottom surface.

Although several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

To aid the Patent Office, and any readers of any patent issued on this application in interpreting the claims appended hereto, applicants note that they do not intend any of the appended claims to invoke 35 U.S.C. § 112(f) as it exists on the date of filing hereof unless the words "means for" or "step for" are explicitly used in the particular claim.

What is claimed is:

1. A torque box comprising:
a front plate; and
a bottom surface coupled to the front plate such that the bottom surface is orthogonal to front plate and such that front plate extends along the bottom surface, the bottom surface defining a first raised portion configured to fit over a wheel of a railcar,
wherein the torque box is aligned with a top chord such that there is no vertical offset between the torque box and the top chord, and
wherein the top chord is a part of a body segment of a railcar.

2. The torque box of claim 1, wherein the bottom surface further defines a second raised portion.

3. The torque box of claim 2, wherein the first raised portion and the second raised portion are positioned on opposite sides of a midline of bottom surface.

4. The torque box of claim 3, wherein the first raised portion and the second raised portion are equidistant from the midline.

5. The torque box of claim 1, wherein the bottom surface defines a third raised portion along a midline of the bottom surface, the third raised portion configured to engage a draft sill of the railcar.

6. The torque box of claim 1, wherein the front plate is shaped to engage the first raised portion.

7. The torque box of claim 1, wherein bottom surface is configured to be positioned above a draft sill of the railcar along a midline of the bottom surface.

8. A railcar comprising:
a body segment;
a wheel structure coupled to the body segment; and
a torque box coupled to the body segment, the torque box comprising:
a front plate; and
a bottom surface coupled to the front plate such that the bottom surface is orthogonal to front plate and such that front plate extends along the bottom surface, the bottom surface defining a first raised portion configured to fit over a wheel of the wheel structure,
wherein the torque box is aligned with a top chord such that there is no vertical offset between the torque box and the top chord, and
wherein the top chord is a part of the body segment.

9. The railcar of claim 8, wherein the bottom surface further defines a second raised portion.

10. The railcar of claim 9, wherein the first raised portion and the second raised portion are positioned on opposite sides of a midline of bottom surface.

11. The railcar of claim 10, wherein the first raised portion and the second raised portion are equidistant from the midline.

12. The railcar of claim 8, wherein the bottom surface defines a third raised portion along a midline of the bottom surface, the third raised portion configured to engage a draft sill of the railcar.

13. The railcar of claim 8, wherein the front plate is shaped to engage the first raised portion.

14. The railcar of claim 8, wherein bottom surface is configured to be positioned above a draft sill of the railcar along a midline of the bottom surface.

15. A method comprising:

attaching a torque box to a well car, the well car comprising a wheel structure, the torque box comprising:

a front plate; and a bottom surface coupled to the front plate such that the bottom surface is orthogonal to front plate and such that front plate extends along the bottom surface, the bottom surface defining a first raised portion configured to fit over a wheel of the wheel structure; and attaching the well car to a railcar, wherein the torque box is aligned with a top chord such that there is no vertical offset between the torque box and the top chord, and wherein the top chord is a part of a body segment of the railcar.

16. The method of claim 15, wherein the bottom surface further defines a second raised portion.

17. The method of claim 16, wherein the first raised portion and the second raised portion are positioned on opposite sides of a midline of bottom surface.

18. The method of claim 17, wherein the first raised portion and the second raised portion are equidistant from the midline.

19. The method of claim 15, wherein the bottom surface defines a third raised portion along a midline of the bottom surface, the third raised portion configured to engage a draft sill of the railcar.

20. The method of claim 15, wherein the front plate is shaped to engage the first raised portion.

21. The method of claim 15, wherein bottom surface is configured to be positioned above a draft sill of the railcar along a midline of the bottom surface.

* * * * *